US007530784B2

(12) United States Patent
Ribassin et al.

(10) Patent No.: US 7,530,784 B2
(45) Date of Patent: May 12, 2009

(54) DEVICE FOR CONTROLLING VARIABLE-PITCH VANES IN A TURBOMACHINE

(75) Inventors: Francois Pierre Georges Maurice Ribassin, Villabe (FR); Dominique Raulin, Avon (FR)

(73) Assignee: SNECMA, Paris (FR)

( * ) Notice: Subject to any disclaimer, the term of this patent is extended or adjusted under 35 U.S.C. 154(b) by 456 days.

(21) Appl. No.: 11/344,207

(22) Filed: Feb. 1, 2006

(65) Prior Publication Data

US 2006/0285969 A1 Dec. 21, 2006

(30) Foreign Application Priority Data

Feb. 25, 2005 (FR) ..... 05 01922

(51) Int. Cl.
*F03B 3/18* (2006.01)

(52) U.S. Cl. ..... 415/160

(58) Field of Classification Search ..... 415/160, 415/161, 163–165
See application file for complete search history.

(56) References Cited

U.S. PATENT DOCUMENTS

| | | | | |
|---|---|---|---|---|
| 4,979,874 A | | 12/1990 | Myers | |
| 5,024,580 A | | 6/1991 | Olive | |
| 5,492,446 A | * | 2/1996 | Hawkins et al. | 415/160 |
| 6,019,574 A | * | 2/2000 | DiBella | 415/160 |
| 6,619,916 B1 | * | 9/2003 | Capozzi et al. | 415/160 |
| 6,802,692 B2 | * | 10/2004 | Bouru | 415/160 |
| 7,004,723 B2 | * | 2/2006 | Raulin et al. | 415/160 |
| 7,223,066 B2 | * | 5/2007 | Rockley | 415/160 |

FOREIGN PATENT DOCUMENTS

| | | |
|---|---|---|
| EP | 1 475 517 A1 | 11/2004 |
| GB | 2 301 867 A | 12/1996 |
| GB | 2 400 416 A | 10/2004 |

* cited by examiner

*Primary Examiner*—Edward Look
*Assistant Examiner*—Sean J Younger
(74) *Attorney, Agent, or Firm*—Oblon, Spivak, McClelland, Maier & Neustadt, P.C.

(57) ABSTRACT

A device for controlling variable-pitch vanes in a turbomachine has rods each having at one end a finger for mounting in a control ring and at its other end an assembly orifice for mounting on a drive square of a vane, the axis of the vane being inclined relative to the axis of the finger of the rod, and the assembly orifice in the rod presenting a dimension in the longitudinal direction of the rod that is greater than that of the drive square, and co-operating therewith to define clearance that varies over the height of the drive square and of the orifice.

12 Claims, 3 Drawing Sheets

DEVICE FOR CONTROLLING VARIABLE-PITCH VANES IN A TURBOMACHINE

The invention relates to a device for controlling variable-pitch vanes in a turbomachine, such as an airplane turbojet, for example.

BACKGROUND OF THE INVENTION

In a turbojet, stages of vanes are mounted between stages of compressor or turbine wheels in order to straighten out the flow of the stream. These vanes are carried by the stator and they are adjustable in pitch position about their respective axes in order to optimize the flow of gas through the nozzles they constitute.

Each stator vane, or variable-pitch vane, includes a cylindrical pin for guiding it in pivoting, the pin being mounted in a cylindrical passage in the casing of the turbojet and being terminated by a drive square having engaged thereon a complementary orifice formed at one end of a rod. The other end of the rod carries a radial cylindrical finger for mounting in a control ring which surrounds the outside of the casing and which is connected to means for turning it about the axis of the turbojet, said drive means being generally constituted by an actuator or an electric motor.

The turning movement of the control ring is transmitted by the rods to the cylindrical pins of the vanes and causes them to pivot about their axes.

A certain amount of precision is required in assembling the rod with the control ring and with the vane pins in order to ensure that all of the vanes are oriented in the same manner in all of their angular positions.

In certain turbomachines, the axes of the vane pins and the axes of the rod fingers are parallel, thus enabling the rods to be mounted without clearance on the control ring and on the vane pins, by moving the rods in radial translation.

In other turbomachines, the axes of the rod fingers are radial, while the axes of the vane pins are inclined relative to a radial direction. During assembly, the rods are engaged on the control ring and on the vane pins by being moved in radial translation, thus enabling the finger of each rod to be mounted without clearance in the control ring, but requiring clearance to be provided at the other end of the rod in order to engage the orifice that is formed at said other end on the drive square provided at the end of the vane pin.

This clearance is needed during assembly because the drive square is inclined relative to the movement in radial translation of the rod, and after assembly this leads to clearance between the rod and the drive square in the longitudinal direction of the rod, and thus to significant lack of precision in the angular positioning of the vane about its axis.

OBJECTS AND SUMMARY OF THE INVENTION

A particular object of the present invention is to eliminate that drawback in a manner that is simple, inexpensive, and effective.

To this end, the invention provides a device for controlling variable-pitch vanes in a turbomachine, in particular an airplane turbojet, the device comprising a control ring mounted to turn about the casing of the turbomachine and connected by rods to the variable-pitch vanes, each rod having at one end a radial finger for assembly in the control ring, and at its other end an orifice for assembly on a drive square formed at the end of a cylindrical pin of the vane, which pin is pivotally guided in a cylindrical passage of the casing, wherein, for the cylindrical pin of the vane having an axis that is inclined relative to the axis of the radial finger of the rod, the assembly orifice in the rod presents a dimension in the longitudinal direction of the rod that is greater than the corresponding dimension of the drive square, and co-operates therewith in said direction to determine clearance that varies over the height of the drive square and of the assembly orifice between a value that is sufficient to allow the assembly orifice to be engaged on the drive square by moving the rod parallel to the axis of its radial finger, and a value that is very small or almost zero when the rod is in place on the drive square.

The device of the invention makes it possible firstly to mount a rod by engaging it in the control ring and on a vane pin by moving the rod in radial translation, because sufficient clearance in the longitudinal direction of the rod is provided for this purpose between the orifice in the rod and the drive square of the blade, and secondly to position the vane angularly in accurate manner about its axis because the clearance is very small or almost zero once the rod is in place on the drive square of the vane.

When the rod is in place on the drive square, said clearance in one particular embodiment is substantially triangular in a plane containing the axis of the drive pin and extending parallel to the longitudinal direction of the rod.

According to another characteristic of the invention, said clearance is formed between a straight face of the drive square extending parallel to the pivot axis of the vane, and an oblique surface of the assembly orifice in the rod, which surface is inclined relative to said pivot axis.

The size of the assembly orifice in the longitudinal direction of the rod then decreases progressively from the radially inner end of said orifice to the vicinity of its radially outer end, after which it is constant to said radially outer end.

In a variant embodiment of the invention, said clearance is formed between a straight surface of the assembly orifice of the rod extending parallel to the pivot axis of the vane, and an oblique face of the drive square that is inclined relative to the pivot axis of the vane.

The size of the drive square in the longitudinal direction of the rod then extends progressively from its radially outer end to the vicinity of its radially inner end, and is then constant to said radially inner end.

BRIEF DESCRIPTION OF THE DRAWINGS

The invention can be better understood and other advantages and characteristics of the invention will appear on reading the following description made by way of non-limiting example and with reference to the accompanying drawings, in which.

MORE DETAILED DESCRIPTION

Figure 1:
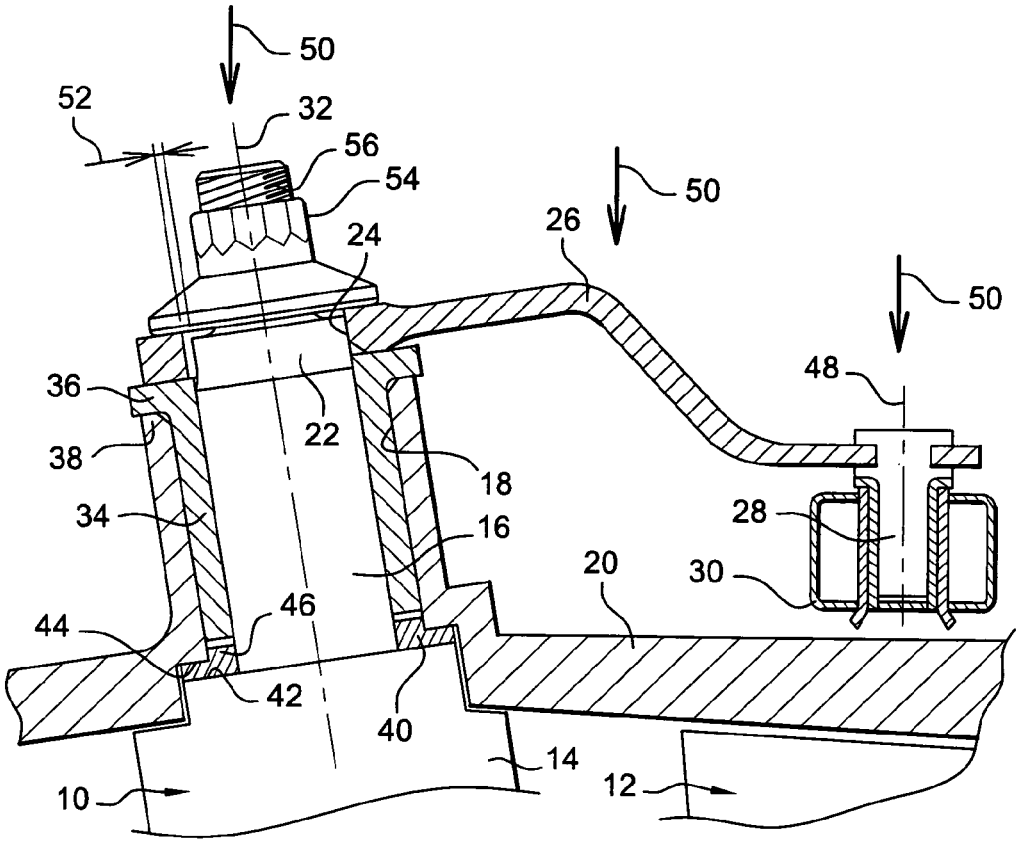
FIG. 1 is a diagrammatic axial section view showing a variable-pitch vane control device of the prior art.

FIG. 1 is a diagrammatic axial section view of a portion of a variable-pitch vane for a high-pressure compressor of a turbomachine, in particular an airplane turboprop or turbojet, the compressor comprising stationary vane stages 10 for straightening out the flow of the gas stream through the compressor, alternating with moving blade stages 12 carried by the rotor of the compressor.

Each stator vane 10 comprises an airfoil 14 and a radially outer cylindrical pin 16 mounted in a cylindrical passage 18 of a casing 20 of the compressor and shaped at its radially outer end with a drive square 22 having engaged thereon a corresponding orifice 24 made in one end of a control rod 26.

The other end of the rod 26 carries a radial cylindrical finger 28 for assembly in a control ring 30 which surrounds the outside of the casing 20 and which is associated with actuator means (not shown) serving to cause it to turn in one direction or the other about the axis of the turbomachine in order to drive the vanes 10 of a stator stage so that they pivot about their axes 32.

The cylindrical pin 16 of the vane 10 is centered and guided in pivoting within the cylindrical passage 18 by means of a cylindrical bushing 34 extending inside the passage 18 over a major fraction of its length, and having an outer annular rim 36 at its outer end bearing against the radially outer edge 38 of the wall of the passage 18.

A guide washer 40 is mounted about the pin 16 of the vane between an annular surface 42 of the vane extending perpendicularly to the vane axis 32, and a corresponding annular surface 44 of the casing 20, and on its inside edge it includes an outer cylindrical rim 46 extending around the pin 16.

The vane axis 32 is inclined relative to a radial direction, while the axis 48 of the cylindrical finger 28 of the rod 26 for connecting the vane 10 to the control ring 30 is radial.

For assembly purposes, the rod 26 is engaged in the control ring 30 and on the drive square 22 of the vane 10 by being moved in translation in a radial direction as represented diagrammatically by arrows 50, thus enabling the finger 28 of the rod to be mounted with substantially no clearance in the control ring 30, but making it necessary to provide clearance 52 at the other end of the rod, between its orifice 24 and the drive square 22 of the vane, said clearance extending in the longitudinal direction of the rod 26.

After the rod 26 has been mounted, it is secured to the pin 16 of the vane by tightening a nut 54 onto a threaded axial extension 56 of the drive square 22.

Figure 2:
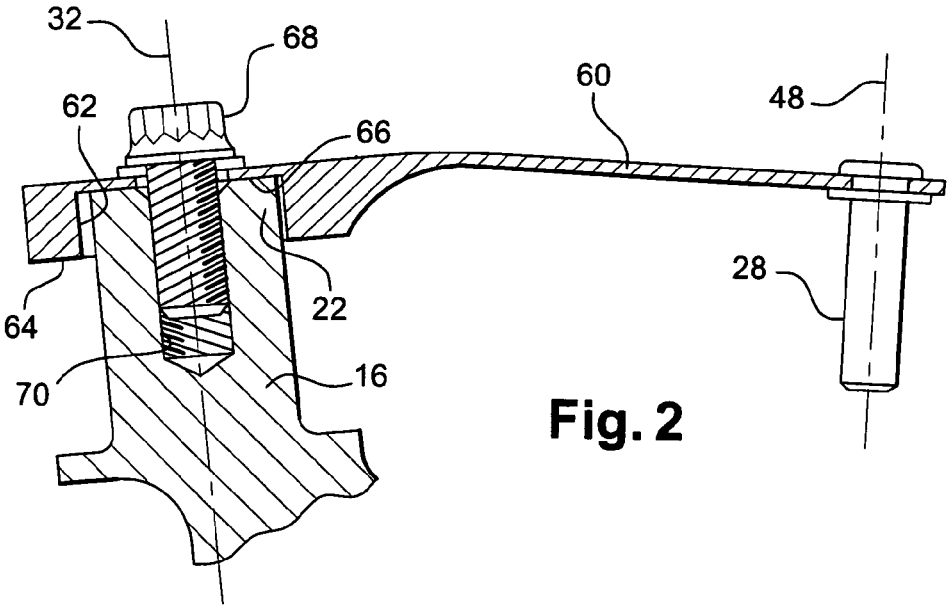
FIG. 2 is a fragmentary diagrammatic axial section view of another prior art variable-pitch vane control device.
Figure 3:
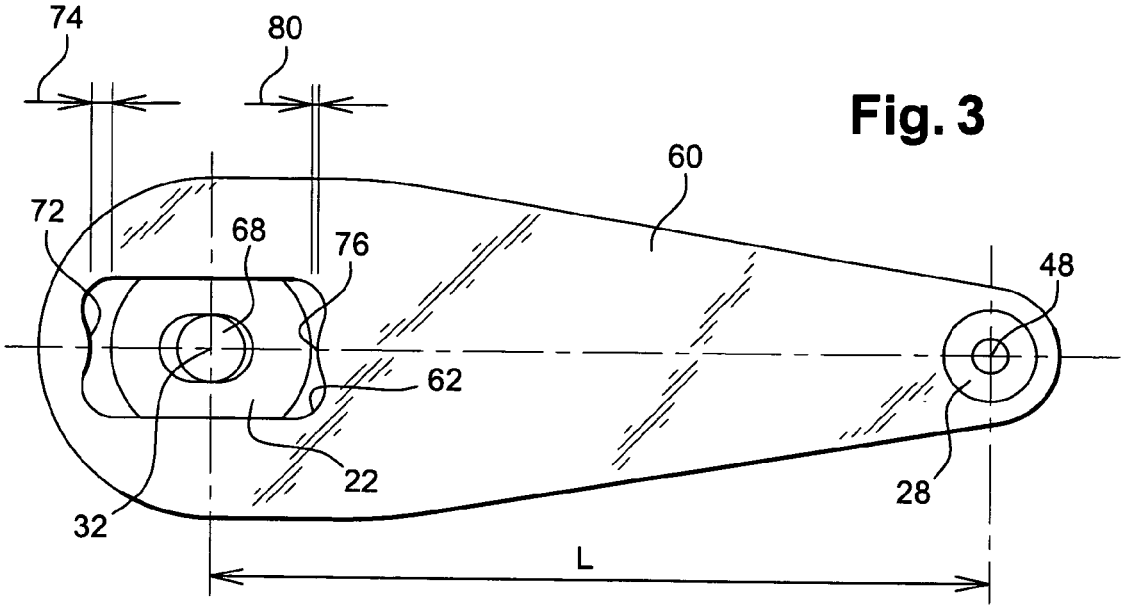
FIG. 3 is a diagrammatic plan view of the rod of the FIG. 2 device.

In a variant, as shown in FIGS. 2 and 3, the orifice of the rod 60 co-operating with the drive square 22 of the vane is formed by a cavity 62 opening out in the radially inner face 64 at the end of the rod 26 and extending over a major fraction of its thickness, with the end wall 66 of the cavity 62 including an orifice for passing a screw 68 that is screwed into a tapped axial hole 70 in the vane pin.

FIG. 3 is a plan view of the rod 60 shown in FIG. 2 and shows an assembly position for the rod 60 on the drive square 22 of the vane.

The clearance needed to enable the orifice 62 in the rod to be mounted on the drive square 22 of the vane, which clearance extends in the longitudinal direction of the rod, leads, after assembly, to a clearance gap 74 extending in this direction between the drive square 22 and a surface 72 of the orifice 62 at its side remote from the finger 28 of the rod, and by a clearance gap 80 in the same direction between the drive square 22 and a surface 76 of the orifice 62 closer to the finger 28.

After being mounted on the drive square, the rod can take any position relative to the drive square in the longitudinal direction of the rod, i.e. the rod can come into contact with the drive square via either one of said faces 72, 76 of the orifice in the rod, as shown in FIG. 1, or else it can occupy an intermediate position, as shown in FIG. 3. As a result, in each of its positions, the distance L between the axis 48 of the finger 28 of the rod and the axis 32 of the vane is different.

Figure 4:
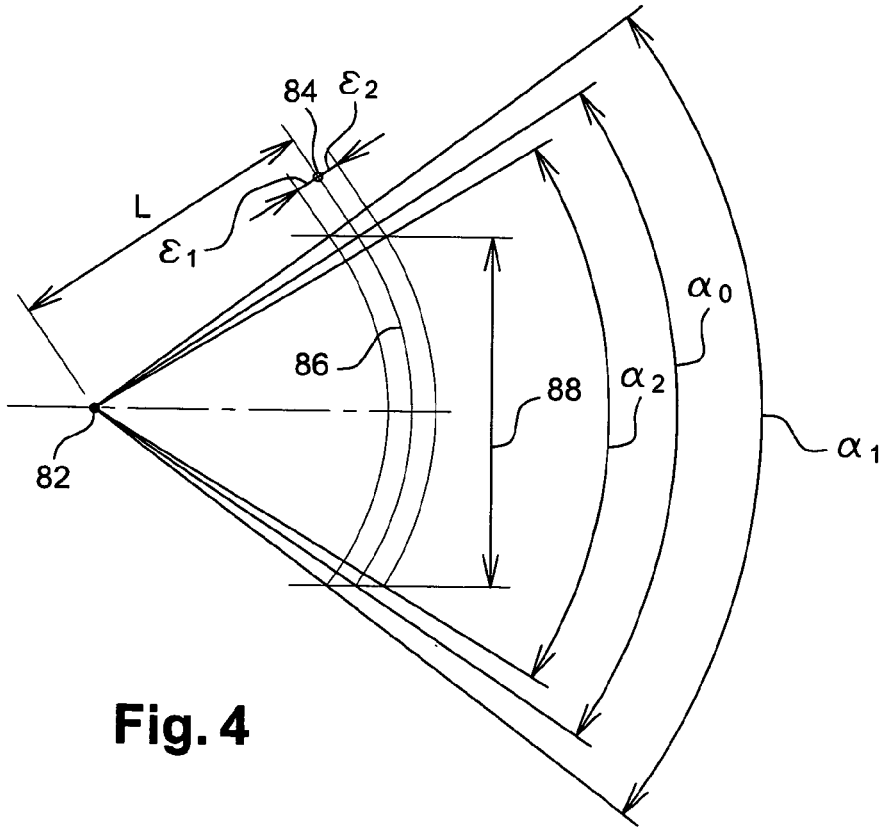
FIG. 4 is a diagram showing the influence of the assembly clearance between the orifice of the rod and the drive square of a vane on the precision with which said vane is positioned angularly.

FIG. 4 is a diagram showing the influence of said distance L on the pivot angle of the vane for the control ring being turned through a given angle.

The point 82 is the point where the axis 32 of the vane intersects the plane of the drawings, with the point 84 and the circular arc 86 representing respectively the point where the axis 48 of the finger 28 of the rod intersects said plane and its trajectory in rotation about the axis 32 of the vane for a the control ring turning through a given distance 88.

Because of assembly clearances, said distance L can lie between a value $L-\epsilon_1$ and $L+\epsilon_2$ corresponding to the two said extreme positions of the rod relative to the drive square of the blade.

When this distance is equal to L, the vane is pivoted by the ring through an angle $\alpha_0$ about its axis.

When the distance is equal to $L-\epsilon_1$, the blade is pivoted about its axis 32 through an angle $\alpha_1$, greater than $\alpha_0$. When the distance is equal to $L+\epsilon_2$, the blade is driven through an angle $\alpha_2$, less than $\alpha_0$.

As a result, in a stator stage, the vanes may all have the same angular orientation in one given position of the control ring, while taking up differing angular orientations when the control ring is turned.

The device of the invention provides a solution to this problem that is simple, effective, and inexpensive.

Figure 5:
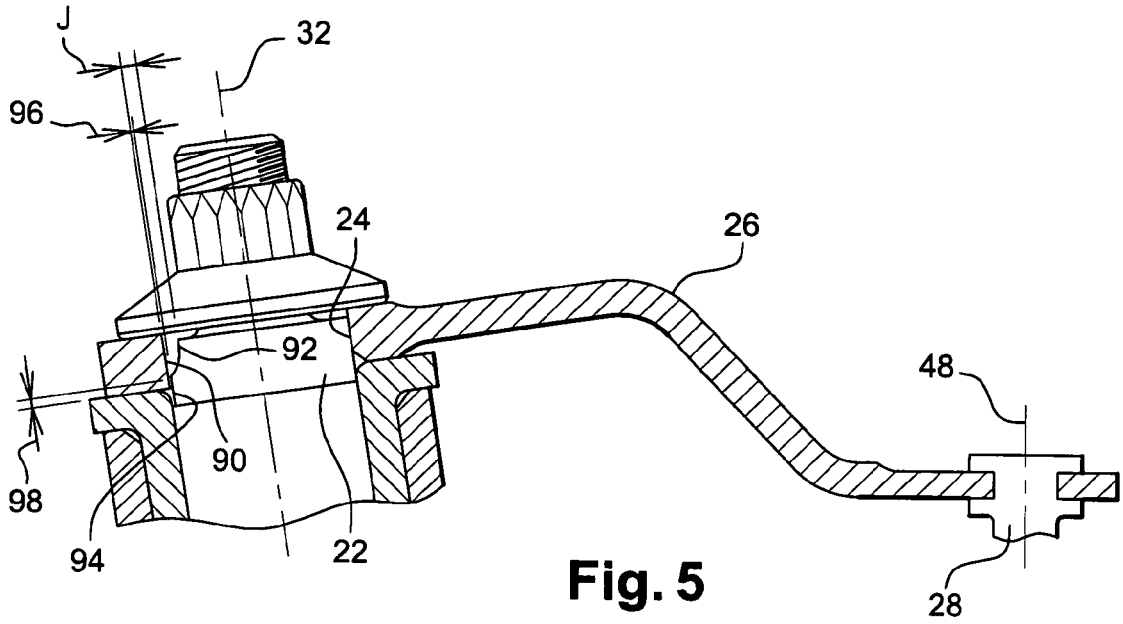
FIG. 5 is a fragmentary diagrammatic axial section view of an embodiment of the device of the invention.

In an embodiment shown in FIG. 5 and corresponding to the device shown in FIG. 1, said clearance for assembling the orifice of the rod on the drive square is formed in the longitudinal direction of the rod 26 between a straight surface 90 of the orifice 24 in the rod, at its side remote from the finger 28 of the rod and extending parallel to the axis 32 of the vane, and an oblique face 92 of the drive square facing the surface 90 and inclined towards the axis 32 of the blade on going radially outwards.

This face 92 can be formed by removing material from the radially outer portion of the drive square, with the remaining radially inner portion of the drive square forming a straight face 94 parallel to the axis of the vane and facing the surface 90 at a distance 96 therefrom that is very small or almost zero, over a height 98 that is sufficient to hold the rod longitudinally to the vane prior to tightening the nut. This height is typically about 0.5 millimeters (mm).

Figure 6:
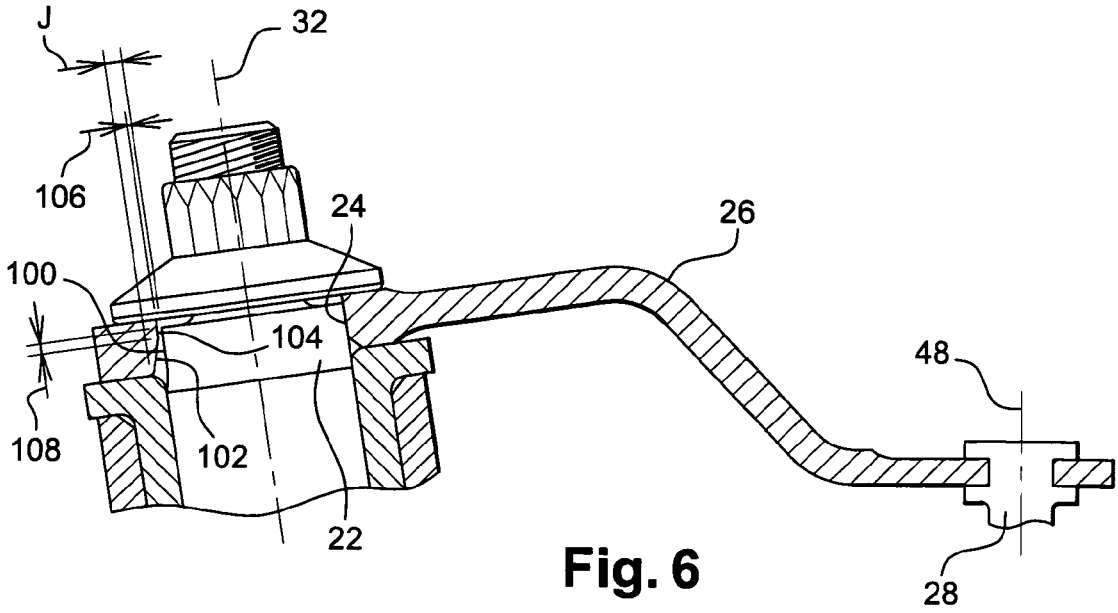
FIG. 6 is a fragmentary diagrammatic axial section view of a variant embodiment of the device of the invention.

In the variant embodiment shown in FIG. 6, the clearance is formed in the longitudinal direction of the rod between a straight face 100 of the drive square of the vane, which face is parallel to the axis 32 of the vane and remote from the finger 28 of the rod, and an oblique surface 102 of the orifice in the rod that faces the face 100, which face is inclined towards the axis 32 of the vane on going radially outwards.

This surface 102 may be formed by removing material from the end face of the orifice 24 in the rod over a fraction of the height of this end face, and from the inside. The remaining radially outer portion of said end face constitutes a straight face 104 parallel to the axis 32 of the vane and facing the face 100 of the drive square at a distance 106 therefrom that is very small or almost zero over a height 108 that is sufficient to hold the rod longitudinally relative to the vane. This height is typically about 0.5 mm.

Said clearance in a plane containing the axis 32 of the vane and extending parallel to the longitudinal direction of the rod may be of a shape that is triangular, or curved, or it may be some other shape.

In these two embodiments, the clearance J at the radially outer end of the orifice in the rod (FIG. 5) or at the radially inner end of said orifice (FIG. 6) is sufficient to enable the rod to be mounted on the drive square by moving the rod radially.

In an embodiment using the configuration of FIG. 1, the angular setting error of the vane corresponding to $\alpha_0-\alpha_1$ and to $\alpha_0-\alpha_2$ in FIG. 4 amounts to ±0.31°. Using the configuration of FIG. 5 or the configuration of FIG. 6, the invention makes it possible to reduce this setting error to ±0.09°, i.e. to reduce it by about 70%.

What is claimed is:

1. A device for controlling variable-pitch vanes in a turbomachine, the device comprising a control ring mounted to turn about the casing of the turbomachine and connected by rods to the variable-pitch vanes, each rod having at one end a radial finger for assembly in the control ring, and at its other end an orifice for assembly on a drive square formed at the end of a cylindrical pin of the vane, which pin is pivotally guided in a cylindrical passage of the casing, wherein, for the cylindrical pin of the vane having an axis that is inclined relative to the axis of the radial finger of the rod, the assembly orifice in the rod presents a dimension in the longitudinal direction of the rod that is greater than the corresponding dimension of the drive square, and co-operates therewith in said longitudinal direction to determine a clearance that varies over the height of the drive square and of the assembly orifice between a value that is sufficient to allow the assembly orifice to be engaged on the drive square by moving the rod parallel to the axis of its radial finger, and a value that is very small or almost zero when the rod is in place on the drive square, said clearance being maintained during operation of the turbomachine, wherein said clearance extends at least along said longitudinal direction so that a portion of said clearance is within a plane containing said radial finger and said pin of the vane, wherein said drive square and said orifice of the rod have respective faces that contact each other and that transmit drive from the rod directly to the vane during normal operation of said device, wherein the drive is transmitted entirely and directly from the rod to the vane by said faces of said drive square and of said orifice of the rod that contact each other.

2. A device according to claim 1, wherein, when the rod is in place on the drive square, said clearance is substantially triangular in a plane containing the axis of the drive pin and oriented parallel to the longitudinal direction of the rod.

3. A device according to claim 1, wherein said clearance is formed between a straight face of the drive square extending parallel to the pivot axis of the vane, and an oblique surface of the assembly orifice in the rod that is inclined relative to said pivot axis.

4. A device according to claim 3, wherein the dimension of the assembly orifice in the longitudinal direction of the rod decreases progressively from the radially inner end of said orifice to the vicinity of its radially outer end, and is then constant to said radially outer end.

5. A device according to claim 4, wherein the orifice in the rod includes a straight surface parallel to the pivot axis of the vane and facing the straight face of the drive square of the vane over a height that is sufficient to hold the rod in its longitudinal direction when it is in place on the drive square.

6. A device according to claim 1, wherein said clearance is formed between a straight surface of the assembly orifice in the rod extending parallel to the pivot axis of the vane, and an oblique face of the drive square that is inclined relative to the pivot axis of the vane.

7. A device according to claim 6, wherein the dimension of the drive square in the longitudinal direction of the rod increases progressively from its radially outer end to the vicinity of its radially inner end, and is then constant to said radially inner end.

8. A device according to claim 7, wherein the drive square of the vane includes a straight face parallel to the pivot axis of the vane and facing the straight face of the orifice in the rod over a height that is sufficient to hold the rod in its longitudinal direction when it is in place on the drive square.

9. A device for controlling variable-pitch vanes in a turbomachine, the device comprising a control ring mounted to turn about the casing of the turbomachine and connected by rods to the variable-pitch vanes, each rod having at one end a radial finger for assembly in the control ring, and at its other end an orifice for assembly on a drive square formed at the end of a cylindrical pin of the vane, which pin is pivotally guided in a cylindrical passage of the casing, the drive square and the orifice of the rod having co- operating shapes for transmitting drive from the rod directly to the vane, wherein, for the cylindrical pin of the vane having an axis that is inclined relative to the axis of the radial finger of the rod, the assembly orifice in the rod presents a dimension in the longitudinal direction of the rod that is greater than the corresponding dimension of the drive square, and co-operates therewith in said longitudinal direction to determine a clearance that varies over the height of the drive square and of the assembly orifice between a value that is sufficient to allow the assembly orifice to be engaged on the drive square by moving the rod parallel to the axis of its radial finger, and a value that is very small or almost zero when the rod is in place on the drive square, wherein said clearance extends at least along said longitudinal direction so that a portion of said clearance is within a plane containing said radial finger and said pin of the vane, wherein said drive square and said orifice of the rod have respective faces that contact each other and that transmit drive from the rod directly to the vane during normal operation of said device, wherein the drive is transmitted entirely and directly from the rod to the vane by said faces of said drive square and of said orifice of the rod that contact each other.

10. A device according to claim 1, wherein said finger is fixed to said rod and said finger does not rotate with respect to said rod.

11. A device according to claim 1, wherein said faces are parallel to said longitudinal direction.

12. A device according to claim 11, wherein said clearance extends between said faces of said rod.

* * * * *